US008981668B2

(12) United States Patent
Shuy et al.

(10) Patent No.: US 8,981,668 B2
(45) Date of Patent: Mar. 17, 2015

(54) DEMAND-SIDE INITIATED DIMMABLE LED LAMP

(71) Applicant: LT Lighting (Taiwan) Corp., Xiangshan Dist., Hsinchu (TW)

(72) Inventors: Geoffrey Wen-Tai Shuy, Taipei (TW); Wen Ten Chang, Kaohsiung (TW); Chang-Horang Li, Hsinchu (TW)

(73) Assignee: LT Lighting (Taiwan) Corp., Hsinchu (TW)

( * ) Notice: Subject to any disclaimer, the term of this patent is extended or adjusted under 35 U.S.C. 154(b) by 31 days.

(21) Appl. No.: 13/791,407

(22) Filed: Mar. 8, 2013

(65) Prior Publication Data

US 2013/0187565 A1 Jul. 25, 2013

(51) Int. Cl.
*H05B 37/02* (2006.01)
*H05B 33/08* (2006.01)

(52) U.S. Cl.
CPC ..... *H05B 37/02* (2013.01); *H05B 33/0824* (2013.01)
USPC ..... 315/293; 315/192

(58) Field of Classification Search
USPC ..... 315/293, 224, 121, 125, 126, 122, 192, 315/186
See application file for complete search history.

(56) References Cited

U.S. PATENT DOCUMENTS

| | | | | |
|---|---|---|---|---|
| 8,492,981 | B2 * | 7/2013 | Shin et al. | 315/185 R |
| 2012/0200235 | A1 | 8/2012 | Shuy et al. | |
| 2013/0002141 | A1 * | 1/2013 | Lee | 315/152 |

FOREIGN PATENT DOCUMENTS

| | | | |
|---|---|---|---|
| EP | 2 391 188 | A1 | 11/2011 |
| KR | 20120137039 | A | 12/2012 |
| WO | 2007107958 | A1 | 9/2007 |
| WO | 2009121956 | A1 | 10/2009 |

* cited by examiner

*Primary Examiner* — Daniel D Chang
(74) *Attorney, Agent, or Firm* — Workman Nydegger

(57) ABSTRACT

A demand-side dimmable LED lamp operable on a direct current power source that powers a lighting subsystem. The dimming unit selects a power consumption level of the lighting system. Such selection changes the efficacy of the lighting subsystem such that a reduction in power consumption actually results in improved efficacy. The selecting might, for example, select a particular passive network that includes LEDs within the lighting subsystem. Each passive network may have different I-V characteristics, and result in different L-P characteristics, thereby effecting the improved efficacy at lower powers.

16 Claims, 7 Drawing Sheets

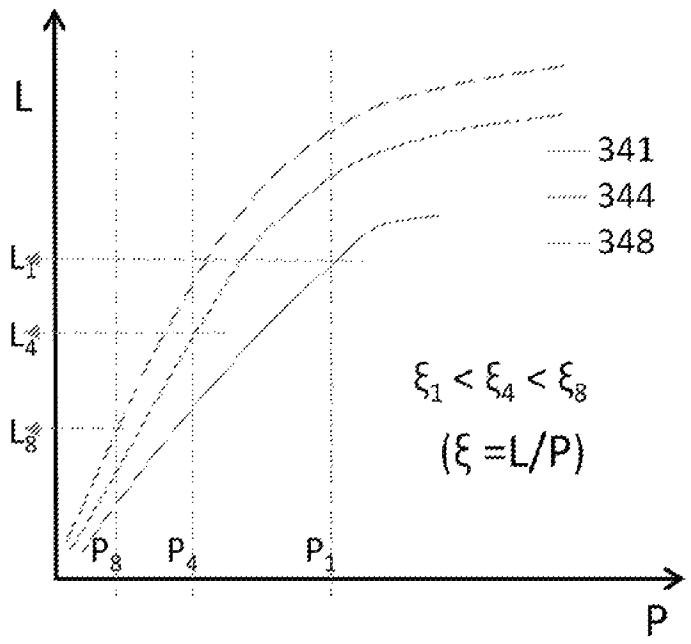
FIG. 2-b
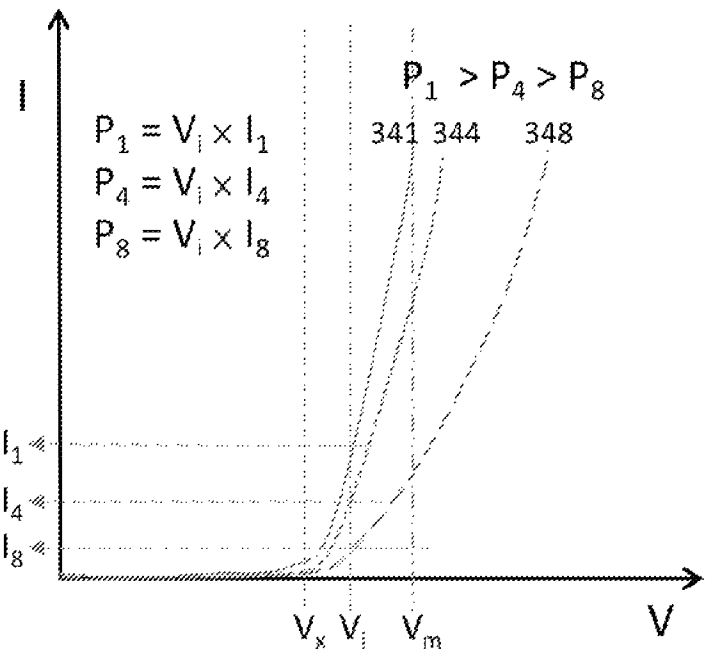
FIG. 2-a

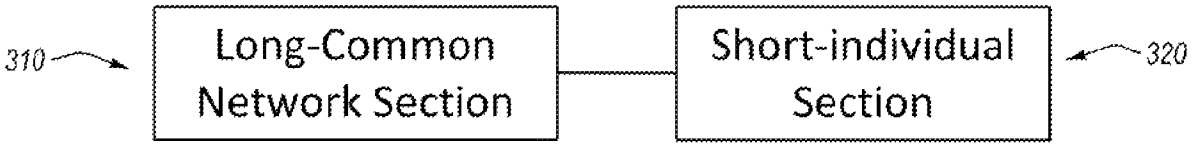
FIG. 3-a
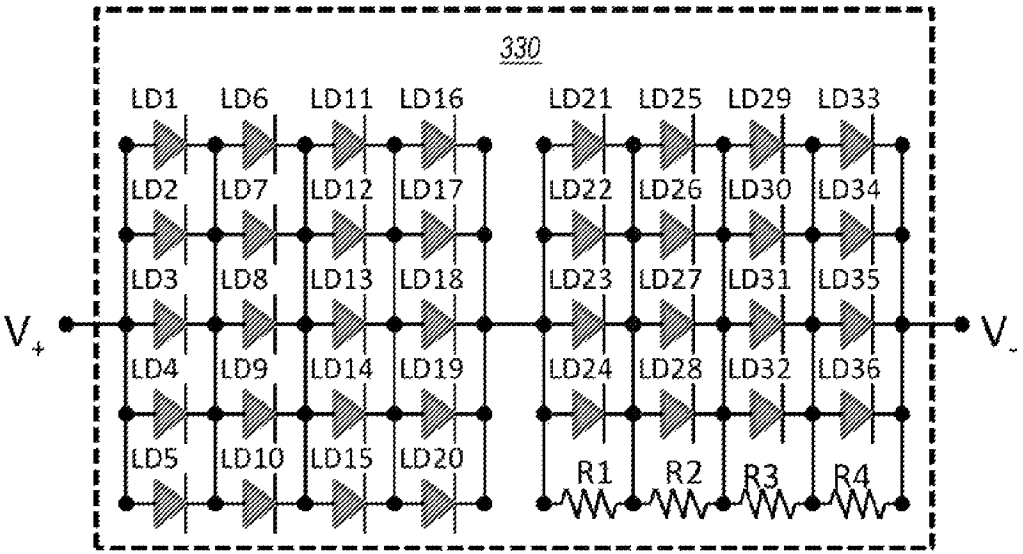
FIG. 3-b

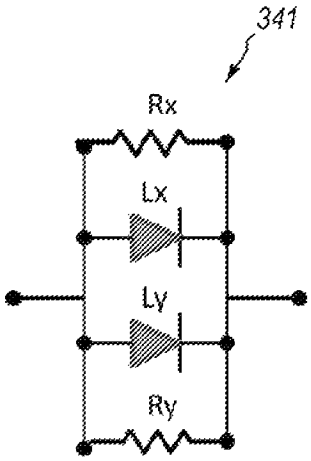
FIG. 3-C-1
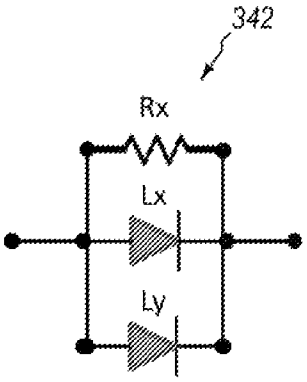
FIG. 3-C-2
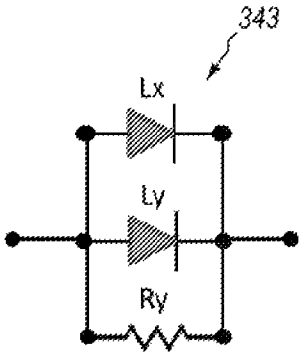
FIG. 3-C-3
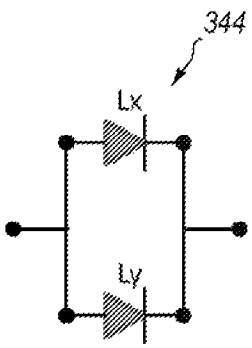
FIG. 3-C-4
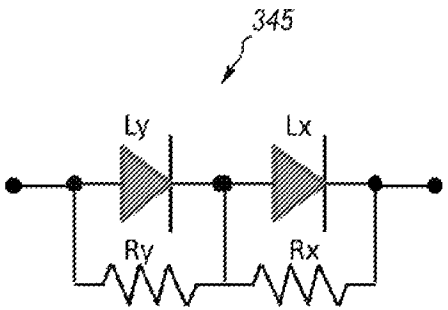
FIG. 3-C-5
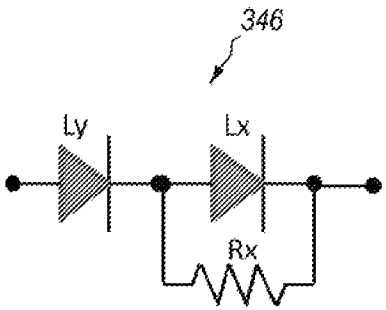
FIG. 3-C-6
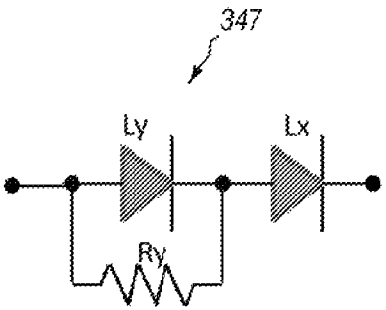
FIG. 3-C-7
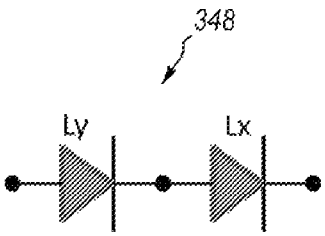
FIG. 3-C-8

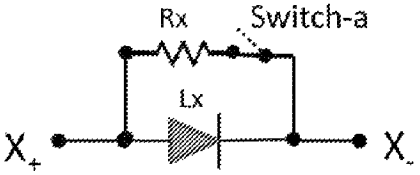
FIG. 4-a-1
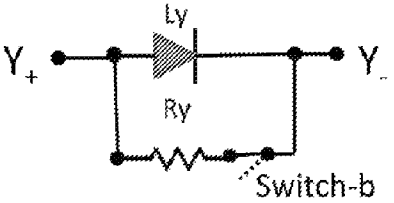
FIG. 4-a-2
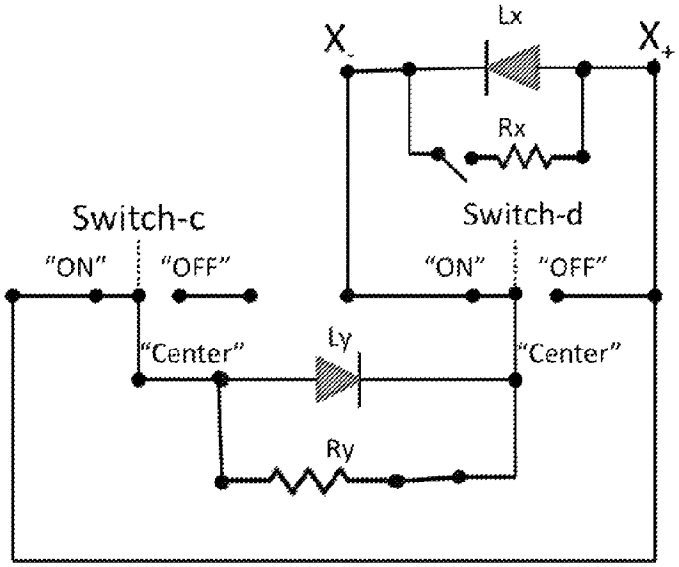
FIG. 4-a-3
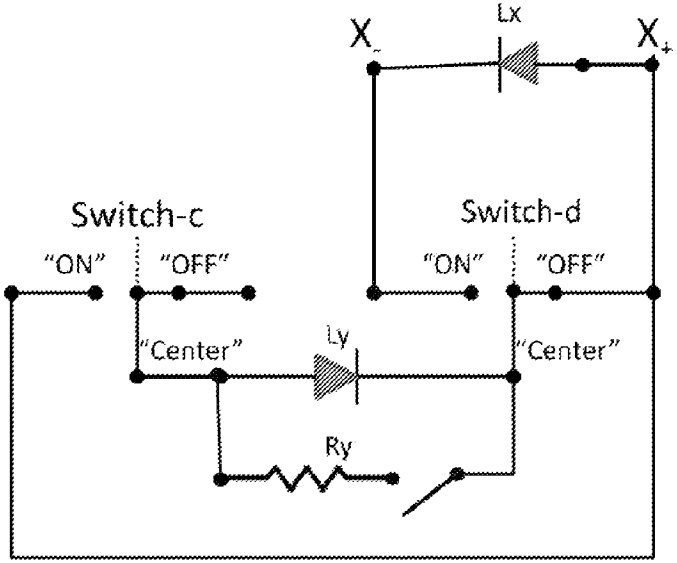
FIG. 4-a-4

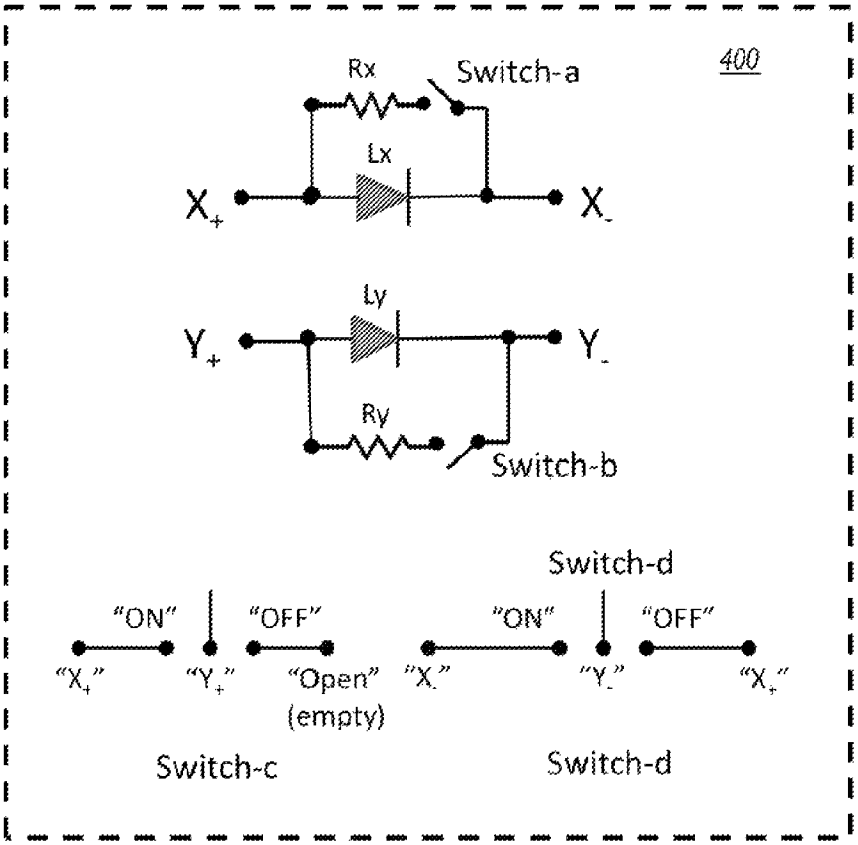
FIG. 4-b

DEMAND-SIDE INITIATED DIMMABLE LED LAMP

BACKGROUND

A dimmer is a device that can change light emissions from lamps by changing the lamp's power consumption. Some lamps, such as fluorescent lamps, do not have commercial dimmers, and thus; their power consumption and brightness remains relatively constant. Other lamps, such as incandescent lamps, can be dimmed by simple dimmer circuitry.

The main component of these dimmers (often a Silicon-Controlled Rectifier (i.e., SCR) or a Triode for Alternating Current (i.e., TRIAC)) is activated by a resistance that is set by a resistor (such as a variable resistor) to produce a periodical current suppression in a portion of the AC power cycles. This periodical current suppression induces a reduction in power-supply to the filament of the incandescent lamps, thus reducing the incandescent lamp light (i.e., thermal) power and thus reducing the lamp brightness.

The filament temperature is reduced due to the reduced heating power caused by activation of the dimmer. The filament's blackbody radiation power (hence the light emission) is very sensitive to its temperature. Every incandescent lamp is designed to optimize against this temperature parameter. Small deviation from its optimum condition would cause great reduction in light emission. Therefore, a small reduction of power consumption in the incandescent lamp would cause a disproportionately greater reduction in brightness. In other words, these dimmers typically reduce the brightness of the incandescent lamp proportionally much more than the reduction of power consumption. For instance, some dimmers could reduce the brightness to 10% of the original level by reducing only 10% of original power consumption. Thus, 90% of power usage produces only 10% of the brightness, as compared to having 100% of the power usage. This is not a desirable property from an energy saving point of view.

Commercial dimmable LED lamps are typically fabricated with Pulse Width Modulation (PWM) and/or TRIAC subsystems. The dimmable LED lamps may also consist of some more subsystems, including 1) an energy source, such as power supply or battery; 2) the LED lighting subsystem consisting of at least one LED; and 3) a constant current (or voltage) drive Integrated Circuits (IC) that regulates the supplied current (voltage) into the LED lighting subsystem. The power supply may be combined with the PWM (or TRIAC) module to become a PWM (or TRIAC) modified power supply.

The PWM subsystem modifies the input power into a form of periodic pulsed current with regulated duty factor. The level of the regulated duty factor causes a corresponding (so-called, "effective") current-level input into the LED lighting subsystem. This current-level (and thus the duty factor of this pulsed current) causes the LED lighting subsystem to produce corresponding light emission levels. The duty factor of the PWM is controlled by circuitry that includes a variable resistor that has a tunable resistance controlled by a knob or other control. To dim the LED lamp, one can use the knob to tune the variable resistor to adjust the duty factor of the PWM resulting in a desired lighting level thereby effectuating the desired dimming operation. The TRIAC performs the periodic input current suppression as described in previous paragraph regulating the "effective" input power as well.

As stated, the commercial designs of dimmable LED lamps all incorporate sophisticated PWM circuitry or TRIACs; regulate the power level supplies into the lamps. In short, these dimmers choke the power (from the supply-side) to a regulated level; and then deliver the power to the lighting subsystems (or the so-called light-bulbs) at regulated levels without altering any part of the LED lighting subsystems, the "light-bulbs". Thus, we categorize these dimmers as "supply-side initiated dimmers", or the "supply-side dimmers" in this patent disclosure. This term, the "supply-side dimmer" is named in contrast to the "demand-side initiated dimmer", or the "demand-side dimmer", which is the inventive concept described in detail hereinafter.

BRIEF SUMMARY

As stated in the background section, all the conventional designs of dimmable LED lamps involve a PWM module and/or TRIAC that regulates the duty factor for powering the lamp; and regulates the amount of power from the supply-side. On the other hand, embodiments described herein do not utilize any duty factor modification or regulation. Thus no PWM or TRIAC is required.

This patent disclosure reveals principles that regulate the amount of power consumption from the demand-side. In short, embodiments described herein transform the LED lamps (the "light-bulbs") from one network configuration with one (say, higher) power demand level into another (say, lower) power demand network configuration. In doing so, it results in a changed (say, lower) lighting level with the associated (say, lower) power consumption, thereby effectuating the dimming operation. Therefore, we name these dimmable LED lamps as the "demand-side initiated dimmable LED lamps" or "demand-side dimmable LED lamps". This disclosure also describes embodiments of novel, and inexpensive designs for demand-side controlled dimmable LED lamps.

As described in the Detail Description section, all prototypes built using the disclosed principles were verified to have energy saving characteristics such that a reduction in light emissions causes a proportionately greater reduction in power consumption. Also, the basic models of the designed prototypes, the dimmable LED lamps utilizing the disclosed principles herein, only involve networks that consistent of some elements of the following: 1) LED(s), 2) resistor(s), 3) variable resistor(s), and/or 4) switch(s). Thus, these dimmable lamps not only provide energy savings, but also can be generically much more affordable than conventional dimmable LED lamps.

Many of the embodiments described herein can further incorporate with remote controllers to become remote controlled dimmable LED lamps; performing the dimming functions remotely. Also, they can be incorporated with necessary sensors (such as motion sensors), and/or timers to control and to perform the suitably designed dimming functions, during specific assigned time period(s). At least one prototype built incorporates a variable resistor; its brightness can be dimmed down continuously.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features can be obtained, a more particular description of various embodiments will be rendered by reference to the appended drawings. Understanding that these drawings depict only sample embodiments and are not therefore to be considered to be limiting of the scope of the invention, the embodiments will be described and explained with additional specificity and detail through the use of the accompanying drawings in which:

FIG. 2A schematically illustrates three selected I-V characteristics and L-P characteristics of eight networks built in a prototype to elaborate the invented design principles described herein;

FIG. 2B schematically illustrates three selected L-V characteristics eight networks built in a prototype to elaborate the principles described herein;

FIGS. 3*a*-3C8 illustrate the network structure in the above prototype;

FIGS. 4*a*1-4*b* illustrate the network resulted in the switch actions.

DETAILED DESCRIPTION

As described in the background section, commercial dimmable LED lamps are typically fabricated with Pulse Width Modulation (PWM) and/or TRIAC subsystems. These dimmers can regulate the input power to a regulated (reduced) level from the supply-side and then deliver this regulated (reduced) power to the lighting subsystems to dim their brightness. Such dimmers are called "supply-side dimmers" herein.

The PWMs and/or TRIACs are relatively expensive, and also take a significant amount of power to operate. Therefore, these designs not only are costly to produce, but also introduce an undesirable dimmer characteristic. Specifically, the undesirable dimmer characteristic includes 1) "a reduction in the light emissions causes a disproportionately lesser reduction in the power consumption", or 2) "a reduction in the power consumption causes a proportionately much greater reduction in the light emission". Thus, these "supply-side dimmers" are not attractive from financial point of view, or from energy saving point of view.

In contrast, the dimmable LED lamps described hereinafter are architected as a lighting subsystem connecting to the dimmer unit, which as whole is operated with a DC energy source. The LED lighting subsystem is built with a passive network (with at least one LED). The energy source is a battery, or a power supply of proper voltage with allowed ripples. Further detail description herein will reveal the crucial differences of the design and operating principles.

Figure 1:
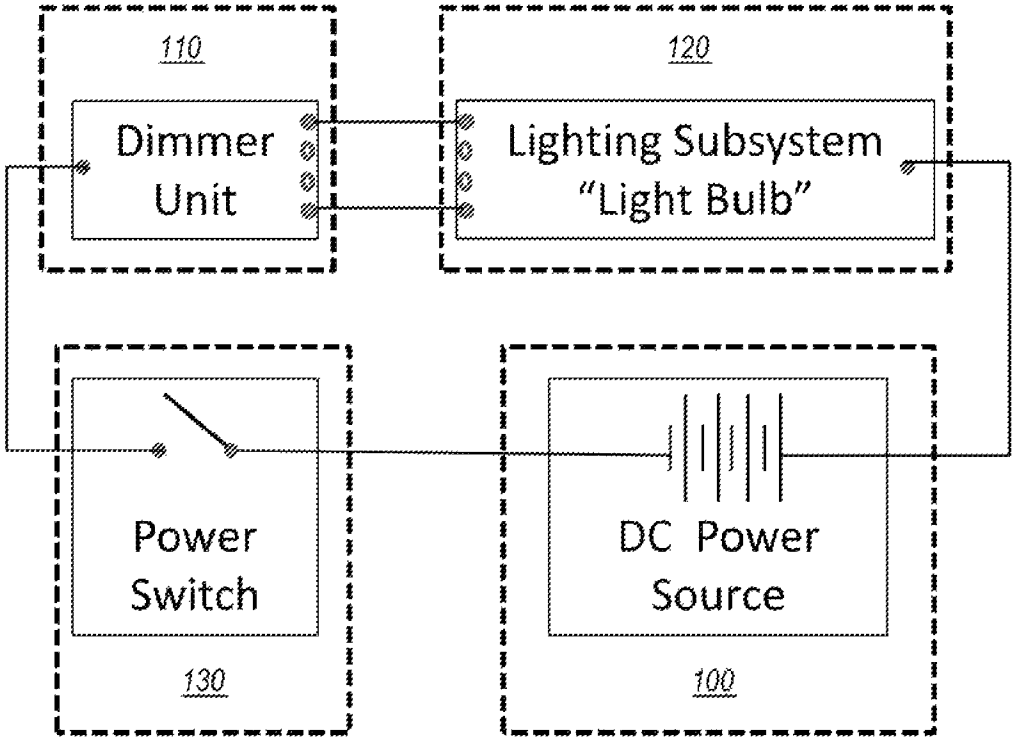
FIG. 1 abstractly illustrates the block structure of the an example "demand-side dimmable LED lamp" in accordance with the principles described herein.

FIG. 1 schematically illustrates (in block diagram form) electrical connections of subsystems of the dimmable LED lamp in accordance with the principles described herein. One end (say, the negative terminal) of a DC power source 100 is connected to one end of a dimmer unit 110 through a power on/off switch 130. The other end of the dimmer unit 110 is connected to one end of the lighting subsystem (or so-call "light bulb") 120 with at least 2 pairs of terminals; then the other end of the "light bulb" 120 is connected to the DC power source 100. Note that the electrical interface between the dimmer 110 and the "light bulb" 120 includes at least two pairs of terminals (i.e., at least two from the dimmer connecting to at least two terminals of the "light bulb"), while the conventional dimmer would use only one pair connection (i.e., one terminal at the dimmer connecting to one terminal at the "light bulb").

To elaborate the design principle, imagine there are three passive networks built in a "light bulb". The I-V characteristics of the three networks are plotted in FIG. 2-*a* schematically, where three networks are labeled as 341, 344, 348. The solid line represents I-V characteristics of the network 341, the dotted line represents that of network 344, and the dashed line represents that of the network 348. Three current values I1>I4>I8 (when operated at voltage V) are also designated in FIG. 2-*a*. One can derive that the power demand (consumption) of the network 341 (P1=V×I1) is greater than that of the network 344 (P4=V×I4), and the P4 is greater than that of the network 348 (P8=V×I8); thus P1>P4>P8.

These three networks also have three different light outputs as function of operating power, the so called "L-P characteristics" of the chosen lamps within the range of operating voltage, Vm to Vx are also plotted schematically in FIG. 2-*a*. The solid line represents the light output of network 341 as function of operating power, the dotted line represents that of network 344, and the dashed line represents that of network 348. When operated at voltage V, the light output of network 341 is L1, that of network 344 is L4, and that of network 348 is L8, while L1>L4>L8; their specific efficacy are also illustrated in FIG. 2-*b*. It is easy to see that the efficacy of network 348 (L8/P8) is greater than that of network 344 (L4/P4); and then greater than that of network 341 (L1/P1) when operated at same voltage.

Imagine that if there is a switching unit built such that it can transform the operating network in the "light bulb" from one of these networks to other; the "light bulb" would behave like a dimmable lamp. This dimmable lamp with the "light bulb" and the switching unit can change its lighting brightness among the three light outputs, L1, L4, and L8; associate with the change of power demand (consumption) among P1, P4, and P8. Furthermore, it can then improve the efficacy with dimming-down, if the switching unit does not consume any power after the network is transformed.

The above described design principles are the basis for the new and inexpensive designs of dimmable LED lamps described herein; and can be abstractly summarized as follows: coupling through designed switch-activation(s) in the dimmer unit 110 of FIG. 1, the lighting subsystem 120 of FIG. 1 can be transformed from one passive network to other network configurations. The later network configurations can be designed to demand less (or more) power consumption than that of the previous network at the same designed operating voltage. This network transformation can then be designed to result in a series of lesser (or greater) light outputs associating with the lesser (or greater) power demands.

Thus, the dimming function is initiated from the demand-side. In other words, the "light bulb" is capable of changing its power demand from one level to other levels; resulting in an ability of modifies the lighting brightness from one level to others. Therefore, we name these dimmable LED lamps as the "demand-side initiated dimmable LED lamps", or the "demand-side dimmable LED lamps" in this patent disclosure.

To clearly elaborate the basic principles described herein, let's examine eight mutually transformable passive networks that are consisted of LEDs and resistors in the following way. First, from a block module point of view shown in FIG. 3-*a*; these eight networks are constructed with a long-common network section 310, as described in FIG. 3-*a*; and followed by short-individual network section 320 to provide eight distinct passive networks. Second, FIGS. 3-*b* and 3-C illustrates from the viewpoint of each block module's passive network. FIG. 3-*b* illustrates a passive network 330 that may be used as the long-common section 310 of the eight passive networks.

Also, the FIGS. 3-C-1 through 3-C-8] illustrates eight short-individual networks (labeled 341 to 348, respectively) collectively representing an example of the short-individual section 320 in FIG. 3-*a*.

The passive network 330 includes multiple passive elements including a combination of LED diodes and resistors. As shown in FIG. 3-*b*, a passive network assembly consists of 36 LED (labeled LD1 through LD36) which are networked into two LED groups serious connecting to each other, and then one end connected to a powering (say, battery) terminal V+, while the other end, V−, is connected to the positive terminal of the short-individual network section of 320 in FIG. 3-*a*; representing the eight networks (labeled 341 through 348 in FIG. 3-*c*).

Among the two LED groups in 330, one of the LED groups consists of a series connection of four LED subgroups; each LED subgroup consisting of five LEDs in parallel connections. For instance, the first LED group described above consists of four series connecting subgroups, wherein the first subgroup consist of five parallel LEDs (LD1 through LD5), the second subgroups consists of another five parallel LEDs (LD6 through LD10), the third subgroups consists of another five parallel LEDs (LD11 through LD15), and the fourth subgroups also consists of another five parallel LEDs (LD16 through LD20). These LEDs may or may not be the same.

Furthermore, the other LED group in 330 described above consists of series connection of four LED subgroups; each subgroup consists of four LEDs and one resistor in parallel connections. For instance, this LED group consists of four series connecting subgroups, wherein the first subgroup consist of four parallel LEDs (LD21 through LD24) and one parallel resistor R1, the second subgroups consists of another four parallel LEDs (LD25 through LD28) and one parallel resistor R2, the third subgroups consists of another four parallel LEDs (LD29 through LD32) and one parallel resistor R3, and the fourth subgroups also consists of another four parallel LEDs (LD33 through LD36) and one parallel resistor R4. Some of the resistors may be the same; while LEDs may or may not be the same.

Now, let's examine the eight short-individual networks (320 in FIG. 3-*a*) illustrated in FIG. 3-*c* (labeled as 341 to 348). These eight networks consist of two LEDs with or without resistors. For instance, network 341 consists of two LEDs (labeled Lx and Ly) and two resistors (labeled Rx and Ry) in parallel connection as shown in FIG. 3-C-1. Network 342 consists of two LEDs (labeled Lx and Ly) and one resistor Rx in parallel connection as shown in FIG. 3-C-2. Network 343 consists of two LEDs (labeled Lx and Ly) and one resistor Ry in parallel connection as shown in FIG. 3-C-3. Network 344 consists of two LEDs (labeled Lx and Ly) in parallel connection as shown in FIG. 3-C-4. Network 345 consists of two LEDs (labeled Lx and Ly) in series connection and two resistors (Rx in parallel connection to Lx and Ry in parallel connection to Ly) as shown in FIG. 3-C-5. Network 346 consists of two LEDs (labeled Lx and Ly) in series connection and one resistor (Rx in parallel connection to Lx) as shown in FIG. 3-C-6. Network 347 consists of two LEDs (labeled Lx and Ly) in series connection and one resistor (Ry in parallel connection to Ly) as shown in FIG. 3-C-7. Network 348 consists of two LEDs (labeled Lx and Ly) in series connection as shown in FIG. 3-C-8. These eight networks can be mutually transformed from one to another through on-off actions of four switches designed in the "dimmer unit"; which will be described further below.

To measure all important physical characteristics of the eight networks, 8 lamps are built using these eight networks; network 341 for the lamp-1, network 342 for the lamp-2, network 343 for the lamp-3, network 344 for the lamp-4, network 345 for the lamp-5, network 346 for the lamp-6, network 347 for the lamp-7, and network 348 for the lamp-8. The important characteristic parameters of the eight passive networks are then obtained by the following: (1) The eight different I-V characteristics are measured within the voltage range of Vm to Vx; (2) their current values and thus their power demand (consumptions) are calculated within the voltage range from Vm to Vx; and (3) their light-outputs as function of power demand (consumptions) are measured within the voltage range from Vm to Vx.

In practical applications, these eight lamps (networks) shall be operated at same voltage, V. The eight current values that flow through the eight networks at this voltage can also be measured respectively. The eight light-output values are measured as function of the design operating voltage (within Vm to Vx). For convenience, the light outputs of these eight lamps are plot as function of operating power. The characteristics are called the "L-P characteristics" of the lamps.

To simplify this explanatory case without losing generality, we chose to draw three out of the eight I-V characteristic curves schematically, and shown in FIG. 2-*a*. The solid line represents I-V characteristics of the network 341, the dotted line represents that of network 344, and the dashed line represents that of the network 348. When operating at voltage V, the three current values I1>I4>I8 also designated in FIG. 2-*a*. One can derive that the power demand (consumption) of the network 341 (P1=V×I1) is greater than that of the network 344 (P4=V×I4), and the P4 is greater than that of network 348 (P8=V×I8); thus P1>P4>P8.

Only the three light outputs as function of operating power, the "L-P characteristics" of the chosen lamps, are plotted schematically in FIG. 2-*b* without lost generality. The solid line represents the light output of lamp-1 as function of operating power, while the dot line represents that of lamp-4 and the dash line represents that of lamp-8. When operated at voltage V, the light output of network 341 is L1, that of network 344 is L4, and that of network 348 is L8, while L1>L4>L8; their specific efficacy (the L/P values) are also illustrated in FIG. 2-*b*.

Now, a lamp (named, lamp-D) is constructed wherein the lighting subsystem is built with a long-common network with 36 LEDs as shown in FIG. 3-*a*; and a short-individual network section with two LEDs (the Lx and Ly described above). The lamp-D is also equipped with a device (called "device-T"). The device-T has two resistors (Rx and Ry) and four switches (switch-a, switch-b, switch-c, and switch-d). The two switches, the switch-a and the switch-b consist of two terminals each, while the switch-c and switch-d each have three terminals, the "center", the "on", and the "off" terminals. The device-T has the following switch effectuations: (1) When switch-a is turned on, the switch-a parallel connects the resistor Rx to the Lx (see FIG. 4-*a*-1); (2) when switch-b is turned on, the switch-b parallel connects the resistor Ry to the Ly (see FIG. 4-*a*-2); (3) when switch-c and switch-d are both turned on, the switch-c and the switch-d parallel connect Lx and Ly (see FIG. 4-*a*-3); and (4) when switch-c and switch-d are both turned off, the switch-c and the switch-d series connects Lx and Ly in the short-individual section of the lighting subsystem (see FIG. 4-*a*-4). The four terminals of Lx and Ly are connected to the terminals of the 4 switches in the specified way shown in block 400 of FIG. 4-*b*; and described in the following paragraph.

Figure 5:
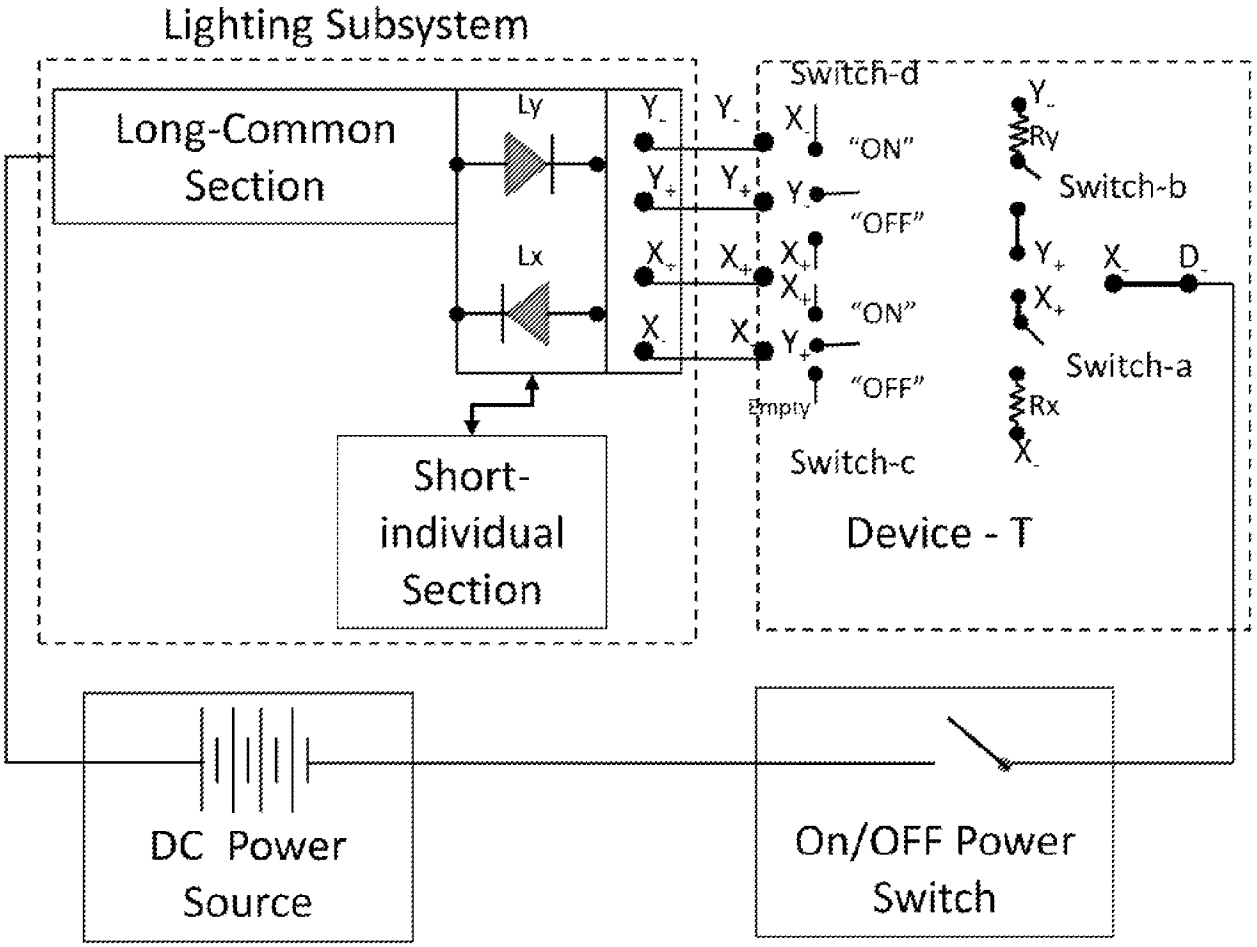
FIG. 5 illustrates a designed electrical connections in the above prototypes

FIG. 5 illustrates the correct electrical connections of the entire system. One end of the long-common network section, the V+ end connects to the positive end of a DC power source (battery or power supply), while the other end shall connect to the positive end of the device-T and that of Ly. The negative end $Y_-$ of Ly connects to the "center" terminal of the switch-d, while the positive end $X_+$ of Lx connects to the "off" terminal of the switch-d and the negative end $X_-$ of the Lx shall connect to the "on" terminal of the switch-d and also to the negative end of the device-T. The positive end $Y_+$ of Ly connects to the "center" terminal of the switch-c, while the positive end $X_+$ of Lx shall connect to the "on" terminal of the switch-c. The resistor Rx is parallel connected to Lx through the "on" state of switch-a. The resistor Ry is parallel connected to Ly through the "on" state of switch-b. Finally, the negative end of device-T connects to the negative terminal of the DC source through an independent on/off power switch.

As described in the previous two paragraphs, the device-T of the lamp-D can transform the lamp-D into any lamp of the lamp-1, lamp-2, lamp-3, lamp-4, lamp-5, lamp-6 lamp-7, and the lamp-8 depending on the switch-states of the four switches in device-T. When the (switch-a)-(switch-b)-(switch-c)-(switch-d) are: (1) in on-on-on-on state, it gives lamp-1; (2) in on-off-on-on state, it gives lamp-2; (3) in off-on-on-on state, it gives lamp-3; (4) in off-off-on-on state, it gives lamp-4; (5) in on-on-off-off state, it gives lamp-5; (6) in on-off-off-off state, it gives lamp-6; (7) in off-on-off-off state, it gives lamp-7 and (8) in off-off-off-off state, it gives lamp-8 respectively.

When operated at the same voltage, the lamp-D will be measured to have the same power consumption and light output as lamp-1, when the device-T transform the network in the lighting subsystem into network 341. In other words, the lamp-D is equivalent to the lamp-1 at this instance. One can view that; at this instance the network 341 is the active network of the lamp-D; while the other 7 networks are the standby (inactive) networks of the lamp-D. When operated at the same voltage, the lamp-D will be measured to have the same power consumption and light output as lamp-2 when the device-T transforms the active network to be the network 342. By the same token, the lamp-D can also become any one of the eight constructed lamps as the device-T transforms the active network of the lamp-D into the network chosen by the designed switching actions in the device-T.

The lamp-D has eight discrete brightness levels plus the off-state. Thus, the lamp-D is a dimmable LED lamp. In this case, the device-T can be viewed as a dimmer unit that effectuates the dimming function for a dimmable LED lamp, the lamp-D. The dimming is initiated by the change of the power demand level which is determined by the active network chosen.

From this description, it should now be clear; for the designed LED lamps utilizing the invented principle described herein, the changes of associated lighting level is induced by the change in power demand; not from the conventional power input regulation. Therefore, the dimmable LED lamps designed in accordance with the invent principles are called the "demand-side initiated dimmable lamps" in this patent disclosure in contrast to the conventional "supply-side regulated dimmable lamps". The dimmers designed from the invention principles are thus called the "demand-side dimmers".

As described above and shown in FIG. 2-*a* and FIG. 2-*b*, this dimmable lamp (with the "light bulb" and the switching unit) can change its lighting brightness among the designed light outputs, including L1, L4, and L8; associate with the change of power demand (consumption) including P1, P4, and P8. Furthermore, it can then improve the efficacy with dimming-down, if the switching unit does not consume any power after the network is transformed. The L8/L1 is measured to be <30%, while P8/P1 is <10%.

Therefore, the next invention step is to design a dimmer unit that consumes insignificant energy during the lighting of the lamp (after the network is transformed). For this step, one can use the invention described in the co-pending patent disclosure titled as "Designs for Control on Solar Power System with Extreme Low Energy Consumption". The patent disclosure described an invention that one can design switches do not consume any energy when they staying in same state (any state) to achieve extreme low energy consumption during our applications. The detail of the invention are described in co-pending, commonly assigned patent application Ser. No. 13/584,198, filed Aug. 13, 2012, the entire contents of which are incorporated herein by reference.

It should be also clear now; the example described above can be easily expanded to design a lamp with a demand-side dimmer (device-T) for selecting an active network configuration from more (or less) than eight transformable network configurations as illustrated in the above example.

Note that by the above, we obtain a set of transformable passive networks with energy efficient I-V characteristics. This results in a good foundation for the design of efficient demand-side initiated dimmable LED lamps. Whether a network has energy efficient I-V characteristics for our design should be judged from lighting performance (efficient L-P characteristics) point of view. The methods for designing a network with desired (modified) I-V characteristics are described in co-pending, commonly assigned patent application Ser. No. 13/312,902, filed Dec. 6, 2011, and published Aug. 9, 2012, the entire contents of which are incorporated herein by reference.

Abstractly, the network transformation can be view as when switching activity performed in the dimmer unit for: (1) adding the build-in passive elements (LEDs or resistors) to the original network in the lighting subsystem; or (2) deleting the build-in passive elements (LEDs or resistors) from the original network; or (3) changing the parallel connecting LEDs into serious connection, and vice versa; or (4) combine actions of the above.

To dim the LED lamp, one can activate the switch(s) to perform the designed network transformation; and result in a designed lighting level changes, thereby effectuating the designed "dimming" operation. These designed dimmers change the power demand levels of the lighting subsystems to result in the change in lighting levels; they are named as the "demand-side dimmers".

All the embodiments of the designed dimmable LED lamps utilizing the disclosed principles herein only involve passive networks of some elements of the following: 1) LED(s), 2) resistor(s), 3) variable resistor(s), and/or 4) switch(s). All the embodiments of the dimmable Light Emitting Diode (LED) lamps utilizing the disclosed principle herein not only reduce their power consumption proportionately greater than the reduction in their lighting brightness, but also are more affordable than the conventional dimmable LED lamps using the "supply-side dimmers".

It is clear that the basic building block of the lighting subsystem is the long-common section of a selected group of passive networks built with LED and resistors; while the basic building block of the dimmer is built with the short individual sections of the passive networks. A data bank was established to collect, to compile, and to categorize all experimental and theoretical data of the ever designed passive networks. The data bank includes the I-V characteristics and L-P characteristics of each compiled network.

In the design practices that came up with good dimmable LED lamps, we used this data bank to come up with a set of desirable passive networks. The elements in the set can be transformed from one to others through switching activities; and weeding out those cannot be easily transformed. Since the networks are with known I-V characteristics and L-P characteristics; they can be examined to see if their efficacies improved from one network with greater light-output to the dimmed next one when operating in the design voltage; then weed out those networks violating this property from this set. Through this, the number of qualified elements may be reduced to a proper number. Then perform the needed designs for the switches and actions in the "dimmer".

A tunable variable resistor may be added to the dimmer unit; creating a proper tunable shunt current-path to power the LED lighting subsystem. This dimmable LED lamp can then be dim-down in a fine tune manner in each (or some of) selected active network. For designs consist of only one passive network, the switch may be omitted and only the tunable variable resistor remained. For designs aiming at applications that do not require a fine tune function, the tunable variable resistors can be omitted and only switch(s) remained. From electrical point of view, the switches in the dimmer designs provide choices from the built in I-V characteristics as a base that determined the starting point for the passing current through the LED lighting subsystem; while the variable resistor then provides the needed fine tune to reach the final current level. From lighting point of view, the switch(s) provide stepping lighting changes, while the tune knob of variable resistor provides a continuous lighting fine adjustment.

At least in one embodiment, we add a remote-control-pairs to deliver/receive the commands to a dimmer such that it can properly dim (even to turn on/off) the lamp remotely. In other words, the invented dimmable LED lamps can be associated with remote control boxes to perform the dimming (and on/off) with remote controls. Also, at least one embodiment we add a timer and a motion sensor to dim down the lighting in certain time period; and brighten up when senses traffics for several (say, three) seconds.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A demand-side dimmable LED lamp comprising:

a direct current power source providing a constant voltage and having a first and second terminal of the direct current power source;

a dimmer unit have a first terminal electrically coupled to the first terminal of the direct current power source, the dimmer unit also having a second terminal; and a lighting subsystem having a second terminal electrically coupled to the second terminal of the dimmer unit, wherein a first terminal of the lighting subsystem is electrically coupled to the second terminal of the direct current power source, wherein the lighting subsystem has a plurality of selectable power consumption levels selectable by the dimming unit, including at least a first power consumption level and a second power consumption level that is less than the first power consumption level, wherein a percentage reduction in a brightness of the lighting subsystem at the second power consumption level as compared to the first power consumption level is less than the percentage reduction of the second power consumption level as compared to the first power consumption level.

2. The LED lamp in accordance with claim 1, wherein the lighting subsystem has a third input terminal electrically coupled to a third terminal of the dimmer unit.

3. The LED lamp in accordance with claim 1, wherein the first power consumption level is achieved by the dimming unit activating a first passive network of the lighting subsystem; and wherein the second power consumption level is achieved by the dimming unit activating a second passive network of the lighting subsystem.

4. The LED lamp in accordance with claim 3, wherein there are a plurality of passive network elements that are shared between the first passive network and the second passive network including at least one Light Emitting Diode (LED).

5. The LED lamp in accordance with claim 1, wherein the lighting subsystem comprises a passive network that includes a first portion that does not change in response to selecting any of the plurality of power consumption levels, and a second portion that does change in response to selecting any of the plurality of power consumption levels.

6. The LED lamp in accordance with claim 1, wherein the plurality of selectable power consumption levels selectable by the dimming unit further include a third power consumption level that is less than the second power consumption level, wherein a percentage reduction in a brightness of the lighting subsystem at the third power consumption level as compared to the second power consumption level is less than the percentage reduction of the third power consumption level as compared to the second power consumption level.

7. The LED lamp in accordance with claim 1, wherein the first terminal of the dimmer unit is selectively coupled to the first terminal of the direct current power source via a power switch.

8. The LED lamp in accordance with claim 1, wherein the direct current power source comprises a battery.

9. A demand-side dimmable LED lamp comprising:

a direct current power source providing a constant voltage across a first and second terminal of the direct current power source;

a dimming unit; and a lighting subsystem powered by direct current generated by the direct current power source, wherein the lighting subsystem has a plurality of selectable power consumption levels selectable by the dimming unit, wherein for at least some of the plurality of selectable power consumption levels, as the selected power consumption level decreases for the constant voltage, an efficacy of the lighting subsystem increases for that constant voltage.

10. The LED lamp in accordance with claim 9, wherein the plurality of selectable power consumption levels number eight or less.

11. The LED lamp in accordance with claim 9, wherein the plurality of selectable power consumption levels number nine or more.

12. The LED lamp in accordance with claim 9, wherein for all of the plurality of selectable power consumption levels, as the selected power consumption level decreases for the constant voltage, an efficacy of the lighting subsystem increases for that constant voltage.

13. The LED lamp in accordance with claim 9, wherein each of the plurality of selectable power consumption levels is selected by the dimming unit selecting a corresponding passive network within the lighting subsystem, each passive network including at least one Light Emitting Diode (LED).

14. The LED lamp in accordance with claim 9, wherein the lighting subsystem comprises a passive network that includes a first portion that does not change in response to selecting any of the plurality of power consumption levels, and a second portion that does change in response to selecting any of the plurality of power consumption levels.

15. The LED lamp in accordance with claim 14, wherein the first portion comprises two segments, a first segment including a series of stages, each stage of the first segment including a plurality of parallel LEDs.

16. The LED lamp in accordance with claim 14, wherein a second segment of the first portion includes a series of stages each including a parallel combination of resistors and LEDs.

* * * * *